US007811116B2

(12) United States Patent
Sakakura et al.

(10) Patent No.: US 7,811,116 B2
(45) Date of Patent: Oct. 12, 2010

(54) CONNECTOR, A CONNECTOR ASSEMBLY AND A CONNECTING METHOD

(75) Inventors: Kouji Sakakura, Yokkaichi (JP); Daisuke Akuta, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/496,853

(22) Filed: Jul. 2, 2009

(65) Prior Publication Data

US 2010/0009566 A1 Jan. 14, 2010

(30) Foreign Application Priority Data

Jul. 10, 2008 (JP) ..... 2008-180484

(51) Int. Cl.
*H01R 13/621* (2006.01)

(52) U.S. Cl. ..... 439/364; 439/709; 439/801

(58) Field of Classification Search ..... None
See application file for complete search history.

(56) References Cited

U.S. PATENT DOCUMENTS 3,090,936 A * 5/1963 Maitby ..... 439/595
5,266,058 A * 11/1993 Sako et al. ..... 439/813
5,580,286 A * 12/1996 Kramer et al. ..... 439/813
5,720,624 A * 2/1998 Ikeda ..... 439/364
5,813,880 A * 9/1998 Kodama ..... 439/364
6,464,538 B2 * 10/2002 Miyazaki et al. ..... 439/607.44
6,824,432 B2 * 11/2004 Katsuzawa et al. ..... 439/709
6,905,375 B2 * 6/2005 Ikeda ..... 439/801
2002/0132522 A1 9/2002 Miyazaki et al.
2007/0105427 A1 * 5/2007 Mori et al. ..... 439/364
2008/0070444 A1 3/2008 Blasko et al.

FOREIGN PATENT DOCUMENTS

JP 2006-031962 2/2006

* cited by examiner

*Primary Examiner*—Michael C Zarroli
(74) *Attorney, Agent, or Firm*—Gerald E. Hespos; Michael J. Porco

(57) ABSTRACT

A connector is provided with terminals (11) to be connected with terminals (32) of a mating connector (30) by bolting and a nut accommodating portion (20) for accommodating nuts (17) for bolting. An entrance (20A) enabling the insertion and withdrawal of the nuts (17) is formed at a connection surface side of the nut accommodating portion (20) with the mating connector. A nut cover (40) for preventing the nuts (17) from coming out through the entrance (20A) is detachably attachable to the nut accommodating portion (20) and includes inverted insertion preventing portions (46) for permitting a connection with the mating connector (30) when the mating connector (30) is in a proper orientation while coming into contact with the mating connector (30) to prevent the connection when the mating connector (30) is not in the proper orientation.

13 Claims, 11 Drawing Sheets

CONNECTOR, A CONNECTOR ASSEMBLY AND A CONNECTING METHOD

BACKGROUND OF THE INVENTION

1. Field of the Invention

The invention relates to a connector in which a terminal is connected by bolting and to a connector assembly.

2. Description of the Related Art

Japanese Unexamined Patent Publication No. 2006-31962 discloses a connector with a terminal that can be bolted into connection with a terminal of a mating connector. The connector has a nut accommodating portion that accommodates a nut for bolting. An entrance extends into the nut accommodating portion and extends along the terminal so that the nut can be inserted and withdrawn. The nut is inserted into the nut accommodating portion and then the terminal is inserted into the housing. Thus, the terminal closes the entrance of the nut accommodating portion and prevents the nut from coming out.

A terminal and a housing of a connector can be formed integrally by insert molding. However, the entrance to the nut accommodating portion of such a connector cannot extend along the terminal. Accordingly, the entrance is provided at a lateral side of the nut accommodating portion and the nut is pressed into the nut accommodating portion. However, the nut may come out of a nut accommodating portion with this construction.

The entrance for the nut could be at a surface of the nut accommodating portion that connects with the mating connector. However, this construction may not permit sufficient space at the connection surface for an inverted insertion preventing structure to prevent a connection if the mating connector is in an improper orientation. Thus, the mating connector may be connected in an improper orientation.

The invention is developed in view of the above situation and an object thereof is to prevent a nut from coming out of a nut accommodating portion and to prevent connection if a mating connector is improperly oriented.

SUMMARY OF THE INVENTION

The invention relates to a connector with at least one terminal to be bolted into connection with at least one terminal of a mating connector. The connector has at least one nut accommodating portion for accommodating at least one nut for bolting. An entrance to the nut accommodating portion is formed at a connection surface side of the connector with the mating connector and enables insertion and withdrawal of the nut. At least one nut cover is mountable to the nut accommodating portion for preventing the nut from coming out through the entrance. The nut cover has at least one improper insertion preventing portion for permitting connection with the mating connector when the mating connector is oriented properly while contacting the mating connector to prevent connection when the mating connector is not oriented properly.

At least one partition wall may partition the nut accommodating portion into a plurality of sections, and the improper insertion preventing portion may be provided at the position of the partition wall.

An engaging piece and a plate piece may project from the cover. A mounting portion may be formed in the partition wall for receiving the engaging piece of the cover. Additionally, a mounting portion may be formed in the nut accommodating portion below a part where the nut is arranged and may receive a plate piece.

An upper surface of the part of the mounting portion that receives the engaging piece may be formed with engaging recesses for receiving engaging projections of the nut cover.

Rear surfaces of the engaging projections may be inclined gradually outward toward the front, and front surfaces of the engaging projections may be substantially perpendicular to the engaging pieces.

The engaging projections may be arranged to be seen from the front through one or more cutouts of the nut cover when the engaging pieces are in a natural state.

The nut cover may have a cover main body, and at least one plate piece may extend from the cover main body substantially along a connecting direction. The plate pieces may project from the cover main body substantially along the connecting direction at a position right below each engaging piece. Thus, spaces are defined between the plate pieces and the engaging pieces for permitting resilient deformations of the engaging pieces.

The plate pieces may be wider, longer and/or thicker than the engaging pieces. More particularly, the plate pieces may be about twice as thick as the engaging pieces.

The height of the improper insertion preventing portion may exceed the thickness of the plate piece, and preferably is slightly larger than half the vertical dimension of the cover main body at the positions of the cutouts.

The nut may be accommodated with substantially no clearance defined in the nut accommodating portion.

The invention also relates to a connector assembly comprising the above-described connector and a mating connector connectable therewith. The connector preferably comprises at least one terminal to be connected with at least one terminal of the mating connector by bolting.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
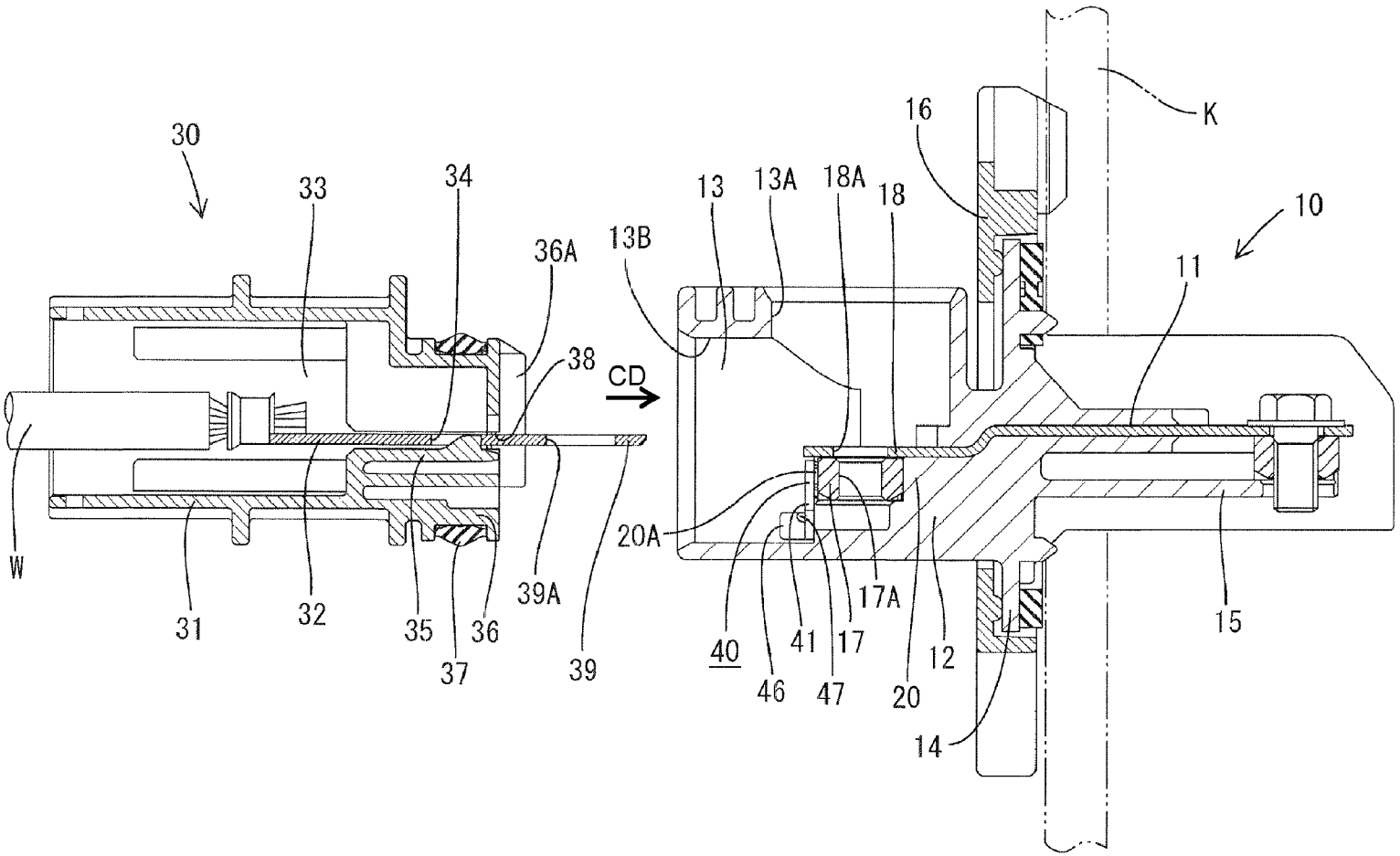
FIG. 1 is a side view in section showing a state before a connector according to one embodiment is connected.

A connector assembly in accordance with the invention is intended for supplying power to an unillustrated device (e.g. a junction box, a load such as a motor, an inverter or the like that may be installed in a hybrid vehicle). The connector assembly is comprised of first and second connectors 10 and 30 that are connectable with each other. In the following description, ends of the connectors 10, 30 that are to be connected are referred to as the front ends and upper and lower sides in FIG. 1 are referred to as upper and lower sides.

The second connector 30 includes a second housing 31 made e.g. of synthetic resin. Cavities 33 are arranged side by side in the second housing 31 and second terminals 32 fixed to ends of wires W (see FIG. 2) are inserted respectively into the cavities 33 from behind. Locking lances 35 are provided at front end portions of the cavities 33 and engage locking holes 34 of the second terminals 32 to retain the second terminals 32 in the cavities 33.

A second fitting portion 36 is defined at a front end portion of the second housing 31 and can fit into a first fitting portion 13 of the first connector 10 as described later. A seal ring 37 is mounted on the outer peripheral surface of the second fitting portion 36 for sealing between the first connector 10 and the second connector 30. Terminal insertion holes 38 are formed in the front wall of the second fitting portion 36 and second connecting portions 39 of the respective second terminals 32 are insertable through the terminal insertion holes 38 in forward and backward directions. The terminal insertion holes 38 are at positions corresponding to the respective cavities 33 and are substantially in the center of the second fitting portion 36 with respect to a height direction. The second connecting portions 39 of the second terminals 32 accommodated in the cavities 33 pass through the terminal insertion holes 38 and project forward from substantially vertical central positions of the second fitting portion 36.

Figure 2:
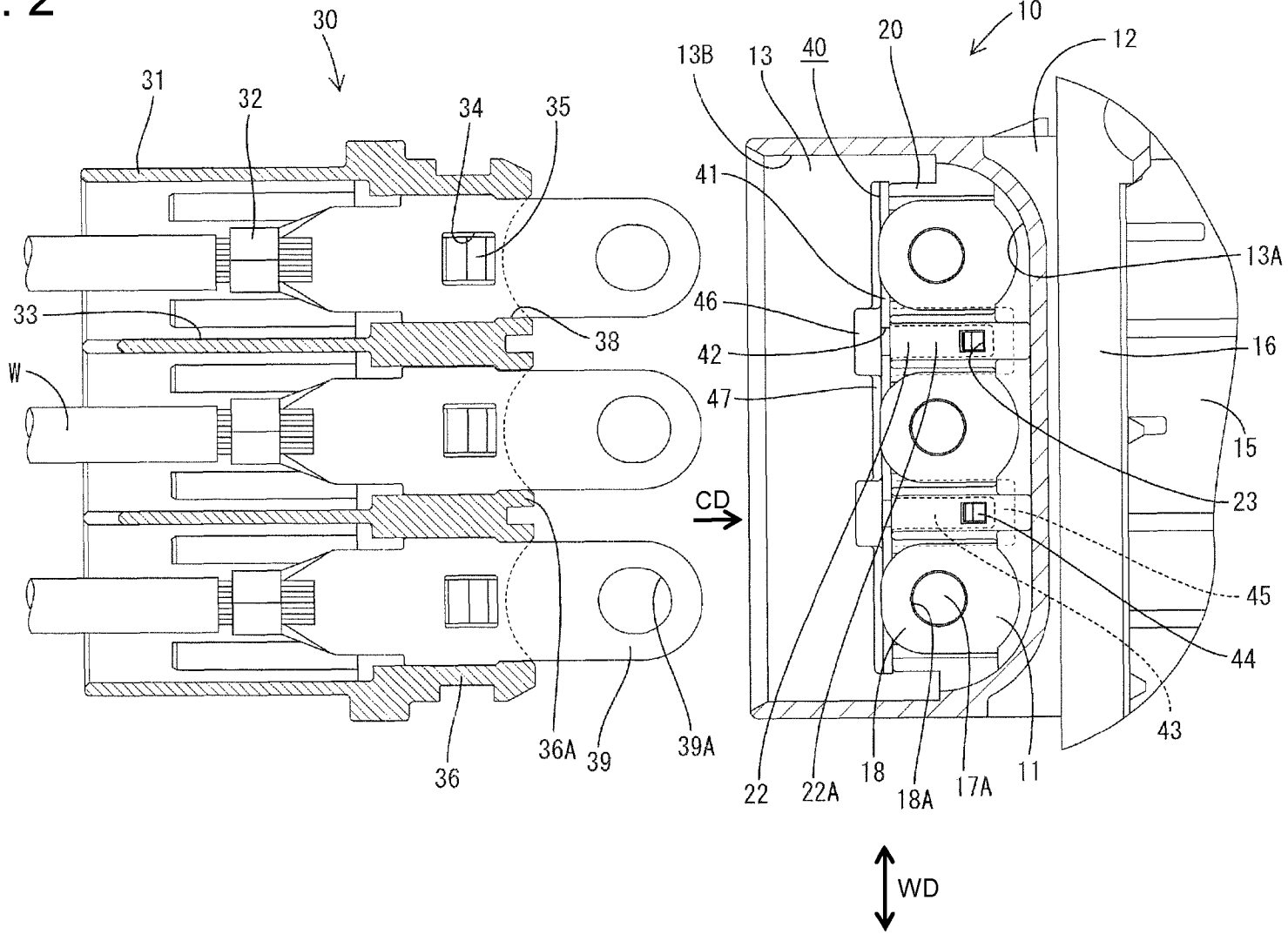
FIG. 2 is a plan view partly in section showing the state of FIG. 1.

Parts of the front surface of the second fitting portion 36 where the terminal insertion holes 38 are recessed arcuately back and parts between the terminal insertion holes 38 define projections 36A that project forward to a greatest extent (see FIG. 2).

The second terminals 32 are long in forward and backward directions and the locking holes 34 are formed at substantially central positions thereof in forward and backward directions. The second connecting portion 39 is defined at a front part of each second terminal 32 before the locking hole 34. An oblong second bolt hole 39A is formed in the second connecting portion 39 and is slightly longer in forward and backward directions.

The first connector 10 is mounted on a conductive metallic casing K provided on and/or at least partly accommodating the device (see FIG. 1). The first connector 10 includes first terminals 11 to be connected in a connecting direction CD with the respective second terminals 32 of the second connector 30 by bolting and a first housing 12 is formed integral to the first terminals 11 preferably by insert molding.

The first housing 12 is made e.g. of synthetic resin and includes a long rectangular first fitting 13, a substantially plate-like flange 14 bulging out over substantially the entire periphery near the rear end of the first fitting 13 and a device-side connecting portion 15 projecting back from the rear of the fitting 14. With the first housing 12 mounted on the casing K, the flange 14 is arranged along the outer surface of the casing K, the device-side connecting portion 15 is accommodated in the casing K and the first fitting 13 projects out from the casing K. The flange 14 is at least partly covered by an aluminum die-cast shielding shell 16 that is mounted to the casing K together with an unillustrated shielding shell for covering the other part of the device connector.

Figure 3:
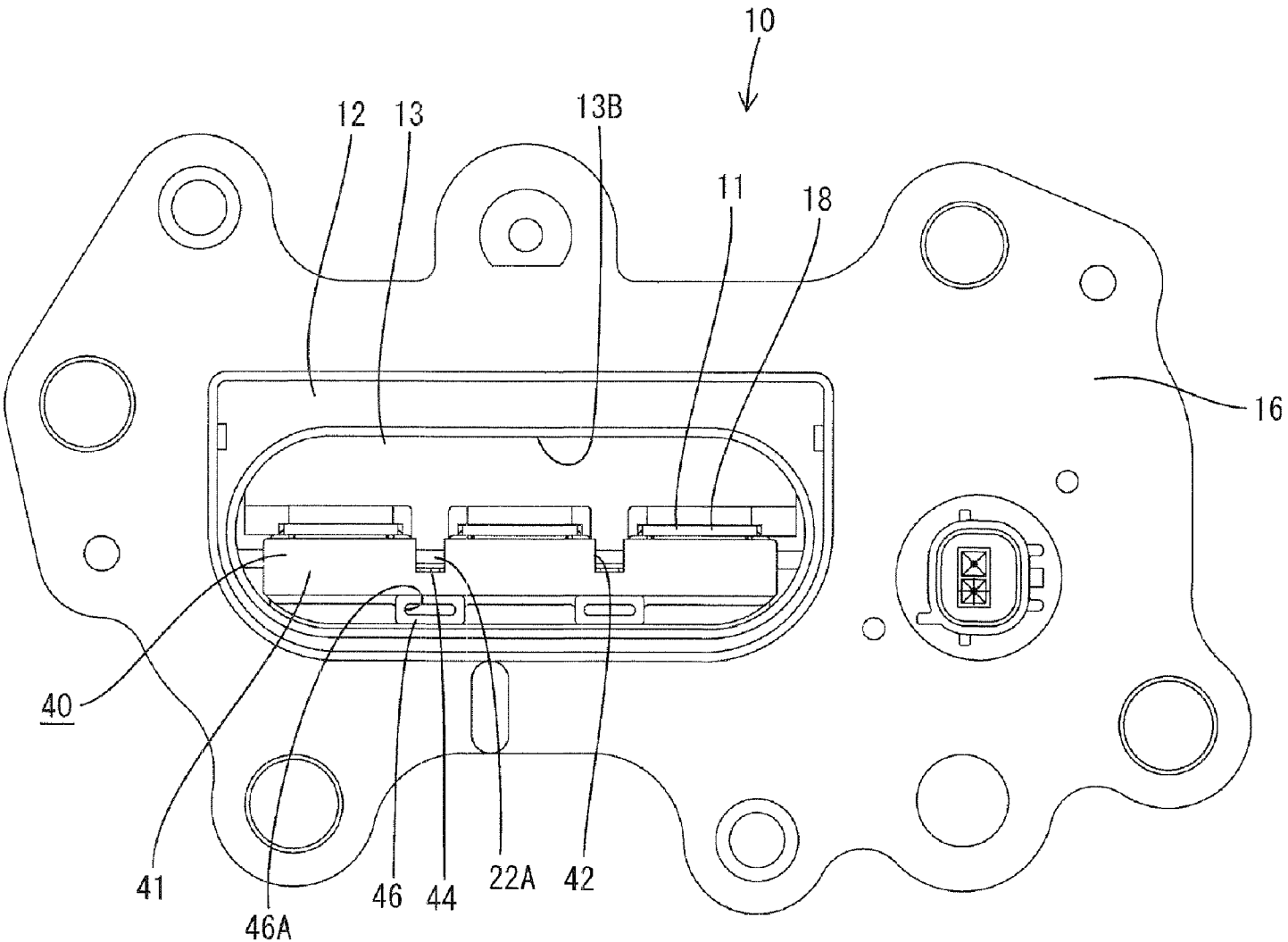
FIG. 3 is a front view of a first connector.

The first fitting 13 has a substantially box shape with a hollow interior, a front opening 13B and upper sides. The front opening 13B has a wide oblong shape for receiving the second fitting 36 of the second housing 31 from the front and along the connecting direction CD (see FIG. 3). The first and second terminals 11, 32 are bolted through an opening 13A at an upper side.

Three first terminals 11 are held in the first housing 12. Each first terminal 11 has one end arranged in the first fitting 13 and the other end arranged in the device-side connecting portion 15. A first connecting portion 18 of each first terminal 11 is formed with a substantially round first bolt hole 18A to be connected with the second terminal 32. The first connecting portions 18 extend substantially along the upper surface of a nut accommodating portion 20 and are arranged at substantially equal intervals in a width direction WD of the first housing 12. The first connecting portions 18 are in substantially the vertical center of the front opening 13B of the first fitting 13. A bolt hole is formed at the other end of the first terminal 11 and is used to connect the first terminal 11 with an unillustrated device-side terminal by bolting.

The first housing 12 includes the nut accommodating portion 20 for accommodating mating connecting means, such as nuts 17, for bolting. The nut accommodating portion 20 is in a rear end portion of the first fitting portion 13 right below the upper opening 13A (FIG. 1) and is wide in the width direction WD. Partition walls 22 partition the nut accommodating portion 20 into three chambers for accommodating three nuts 17. Each nut 17 is accommodated in the nut accommodating portion 20 with an axial line thereof oriented vertically and substantially normal to the connecting direction CD and the width direction WD. The upper surface of the nut 17 extends substantially along the lower surface of the first connecting portion 18 of the first terminal 11 and a shaft hole 17A of the nut 17 is arranged substantially coaxially with the first bolt hole 18A. The shaft hole 17A of the nut 17 has a substantially round shape slightly smaller than the first bolt hole 18A. Each nut 17 is accommodated with substantially no clearance defined to the nut accommodating portion 20.

An entrance 20 enabling the insertion and withdrawal of the nuts 17 A is formed at the front of the nut accommodating portion 20, which is the connection surface side with the second connector 30. A nut cover 40 is mountable or detachably attachable to the nut accommodating portion 20.

Figure 6:
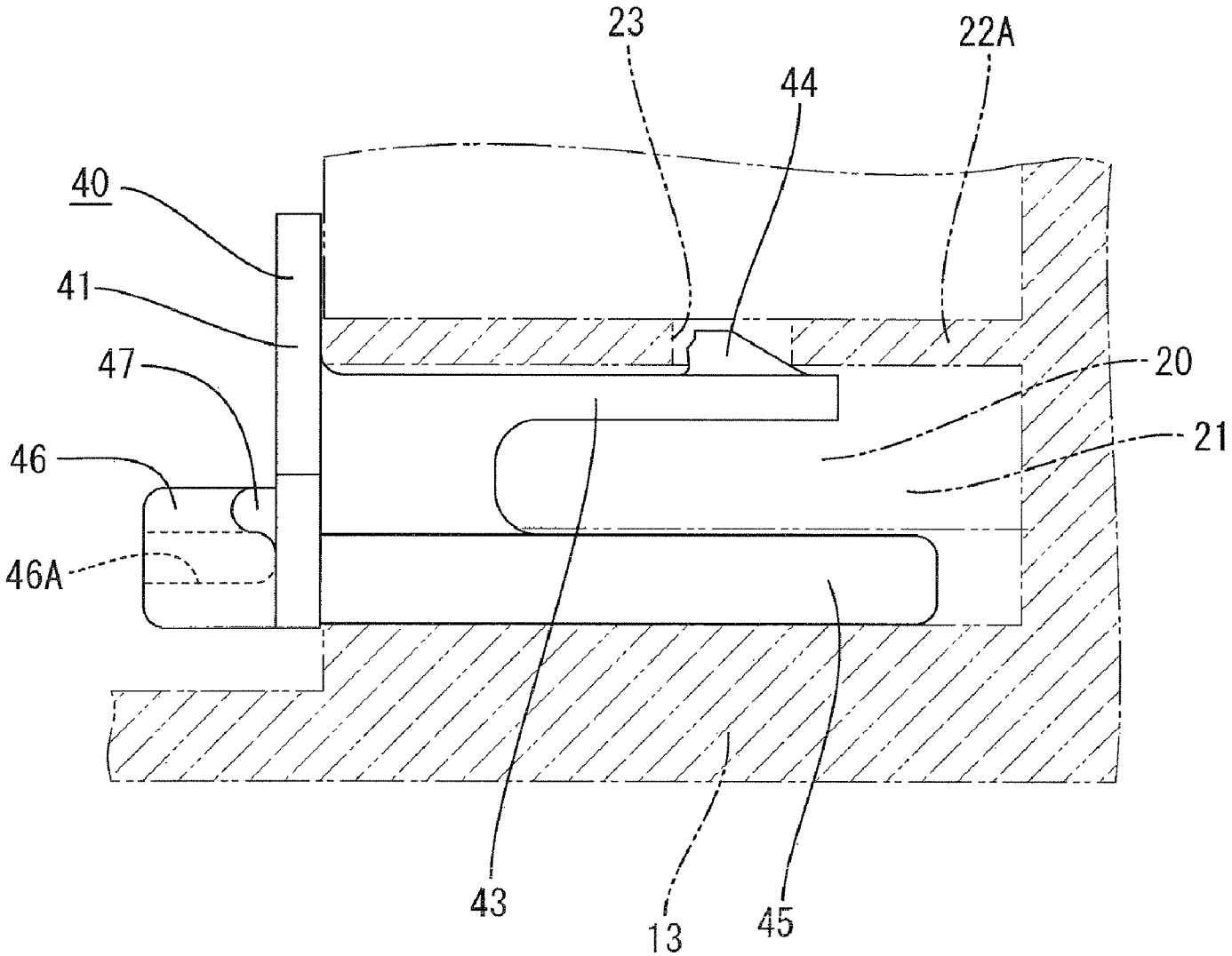
FIG. 6 is a conceptual diagram showing a state where the nut cover is mounted.

Mounting portions 21 are formed in the nut accommodating portion 20 for receiving engaging pieces 43 and plate pieces 45 of the nut cover 40 (see FIG. 6). Parts of the mounting portions 21 that receive the engaging pieces 43 are formed in the partition walls 22 and parts that receive the plate pieces 45 are formed in parts of the nut accommodating portion 20 below the nuts 17 and the partition walls 22. Engaging recesses 23 vertically penetrating ceiling surfaces 22A of the partition walls 22A and receive engaging projections 44 of the nut cover 40.

The nut cover 40 is made e.g. of synthetic resin and includes a cover main body 41 for covering the entrance 20A of the nut accommodating portion 20. The cover main body 41 is a wide substantially rectangular plate that extends along the front surface of the nut accommodating portion 20. The width of the cover main body 41 is equal to the width of the nut accommodating portion 20 (see FIG. 2) and the height thereof is equal to a vertical dimension of the nut accommodating portion (preferably more than about 1.5 times, more preferably about twice the dimension of the nuts 17 in the axial direction) (see FIG. 1).

Figure 4:
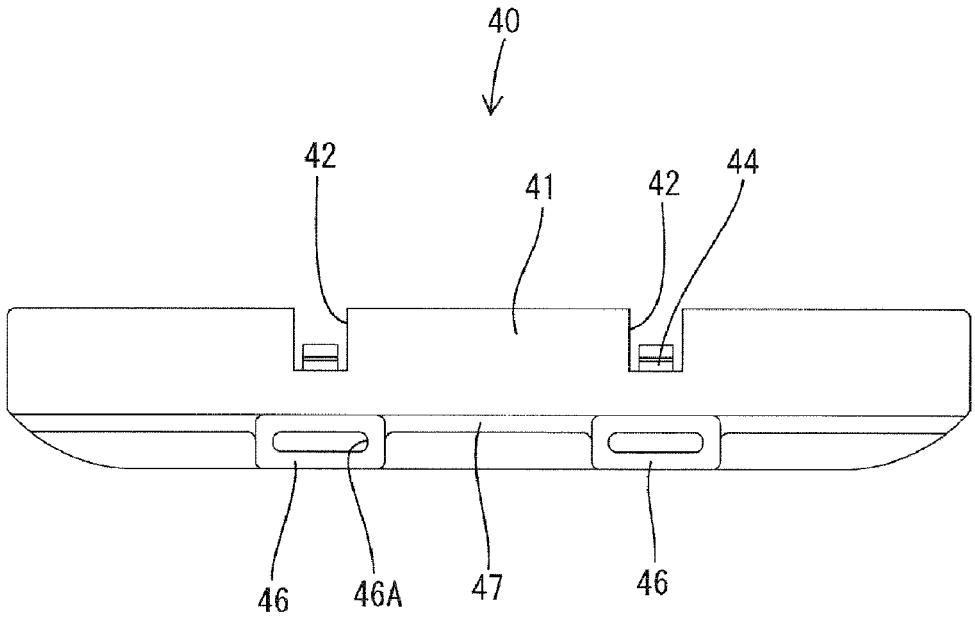
FIG. 4 is a front view of a nut cover.

Two cutouts 42 are formed at an upper edge portion of the cover main body 41 (see FIG. 4). The cutouts 42 are at positions substantially equally dividing the cover main body 41 in the width direction WD at positions corresponding to the partition walls 22 of the nut accommodating portion 20. The cutouts 42 are substantially rectangular recesses extending from the upper edge of the cover main body 42 to positions slightly above vertically central positions (short side direction).

Two engaging pieces 43 are cantilevered back from the cover main body 41 (see FIG. 6) and are resiliently deformable up and down in directions intersecting the connecting direction CD. The engaging pieces 43 are spaced apart in the width direction WD and can be accommodated in the cutouts 42 of the cover main body 41 (see FIG. 5). The respective engaging pieces 43 are plates that are long and narrow in forward and backward directions and have substantially the same width as the respective cutouts 42. Upper surfaces of the engaging pieces 43 are substantially flush with the bottom surfaces of the respective cutouts 42.

Engaging projections 44 are provided on the upper surfaces of the respective engaging pieces 43 (see FIG. 6) and near the free rear ends of the engaging pieces 43. The engaging projections 44 are shaped to be fit into the engaging recesses 23 of the nut accommodating portion 20 and project up in a direction intersecting the connecting direction CD. Rear surfaces of the engaging projections 44 are inclined gradually up toward the front, and the front surfaces thereof are substantially perpendicular to the engaging pieces 43. The engaging projections 44 are arranged to be seen from the front through the respective cutouts 42 when the engaging pieces 43 are in a natural state (see FIG. 4).

Plate pieces 45 are cantilevered rearward from the lower edge of the cover main body 41 of the nut cover 40 and extend substantially along the connecting direction CD (see FIG. 6). The plate pieces 45 is are provided right below the respective engaging pieces 43 while leaving space for resilient deformation of the engaging pieces 43. The plate pieces 45 are wider, longer and thicker than the engaging pieces 43. More particularly, the plate pieces 45 are about twice as thick as the engaging pieces 43.

The nut cover 40 includes projections 46 for permitting connection of the second connector 30 when the second connector 30 is in a proper orientation while contacting the second connector 30 to prevent the connection when the second connector 30 is not in the proper orientation (e.g. vertically inverted).

Figure 5:
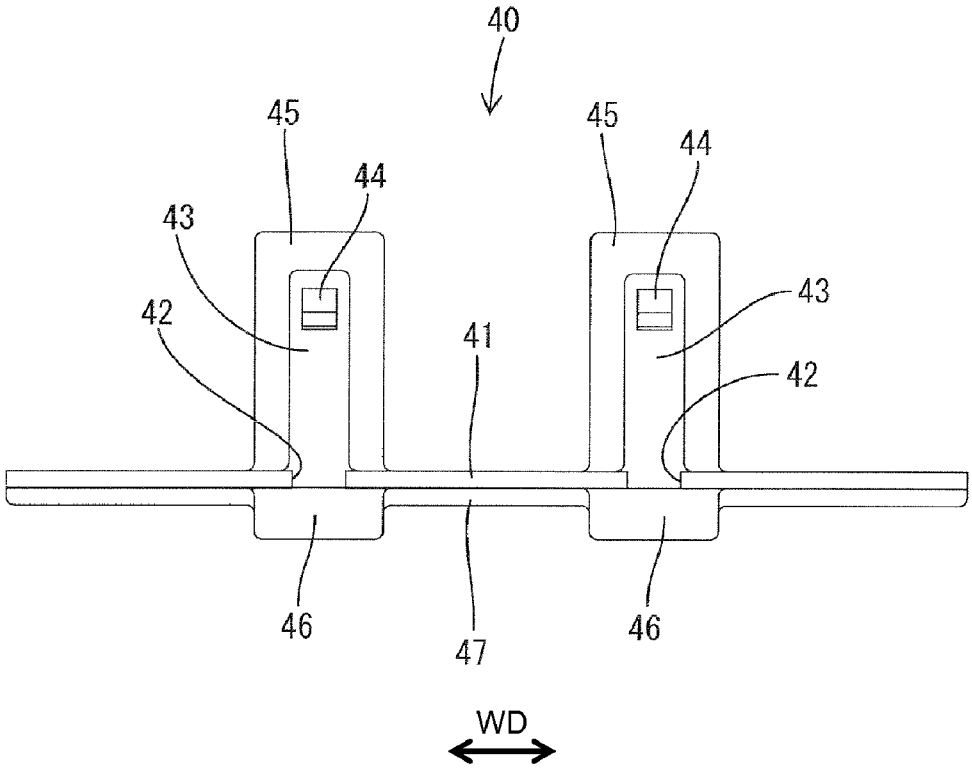
FIG. 5 is a plan view of the nut cover.

Two projections 46 project forward along the connecting direction CD from a bottom end portion of the cover main body 41 and are spaced apart in the width direction WD (see FIG. 5). Each projection 46 is a wide substantially rectangular block that extends along the bottom edge of the cover main body 41 when viewed from the front (see FIG. 4). The height of each projection 46 exceeds the thickness of the plate pieces 45 and is slightly larger than half the vertical dimension of the cover main body 41 at the positions of the cutouts 42.

The projections 46 are offset down from the front projections 36A of the second housing 31 when the second connector 30 is in the proper orientation. However, the projections 46 face the front projections along the connecting direction CD when the second connector 30 is vertically inverted.

A wide forwardly open hole 46A is formed in a substantially central part of each projection 46 (see FIG. 4). The hole 46A has a depth as to reach the front surface of the cover main body 41 (see FIG. 6).

Ribs 47 are provided on the front surface of the cover main body 41 between the adjacent projections 46 and at the outer sides of the respective projections 46. The ribs 47 project forward along the connecting direction CD for a projecting distance that substantially equals the thickness of the cover main body 41. The ribs 47 extend laterally straight along the upper edges of the projections 46. A vertical dimension of each rib 47 is substantially equal to a vertical dimension of the parts of the projections 46 above the holes 46A.

Figure 7:
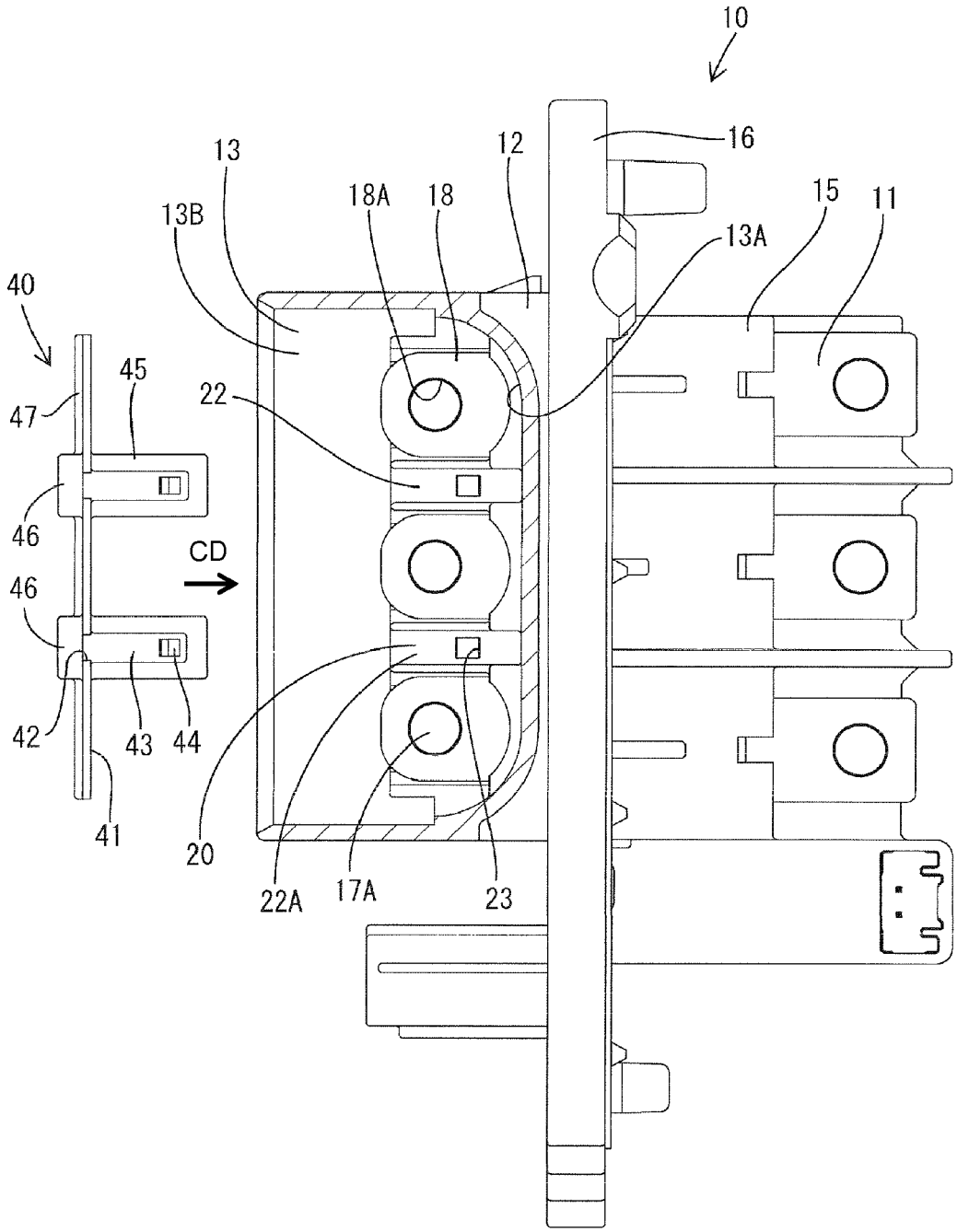
FIG. 7 is a plan view partly in section showing a state before the nut cover is mounted.
Figure 8:
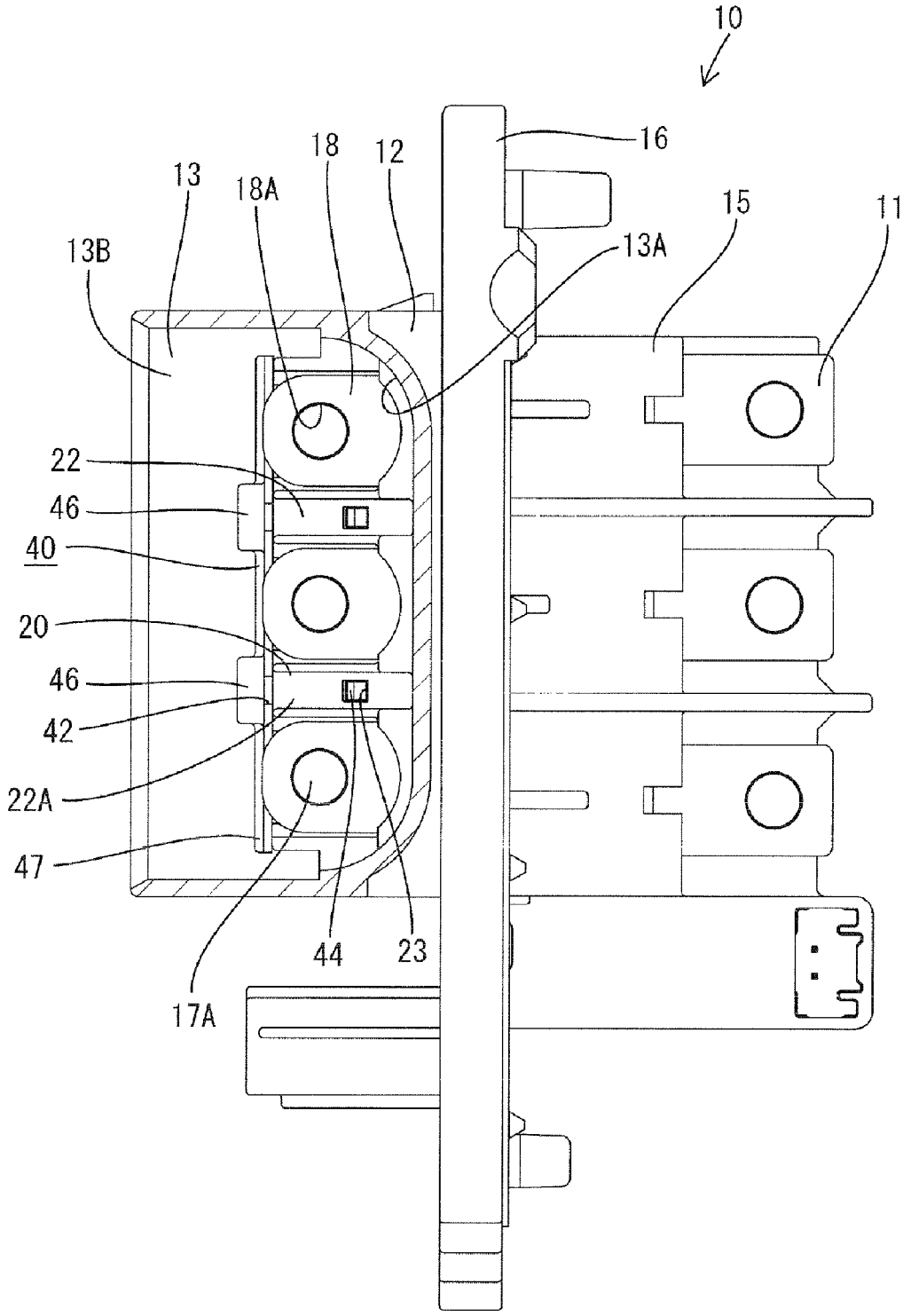
FIG. 8 is a plan view partly in section showing a state where the nut cover is mounted.

The nut cover 40 is mounted into the nut accommodating portion 20. More particularly, the nuts 17 are pushed in through the entrance 20A to be accommodated in the nut accommodating portion 20. The nut cover 40 then is oriented so that the engaging pieces 43 substantially project back along the connecting direction CD (see FIG. 7) and the engaging pieces 43 are inserted and pushed into the mounting portions 21 of the nut accommodating portion 20. As a result, the engaging projections 44 of the engaging pieces 43 contact the ceiling surfaces 22A of the partition walls 22 to deform the engaging pieces 43 resiliently down in a direction intersecting with the connecting direction CD. The engaging pieces 43 return resiliently upward (see FIG. 6) when the engaging projections 44 reach the engaging recesses 23 so that the engaging projections 44 fit into the engaging recesses 23. In this way, the engaging projections 44 and the engaging recesses 23 engage and the nut cover 40 is held mounted to the nut accommodating portion 20 (see FIG. 8). At this time, the cover main body 41 closes the entrance 20A by covering the front surface of the nut accommodating portion 20.

Figure 9:
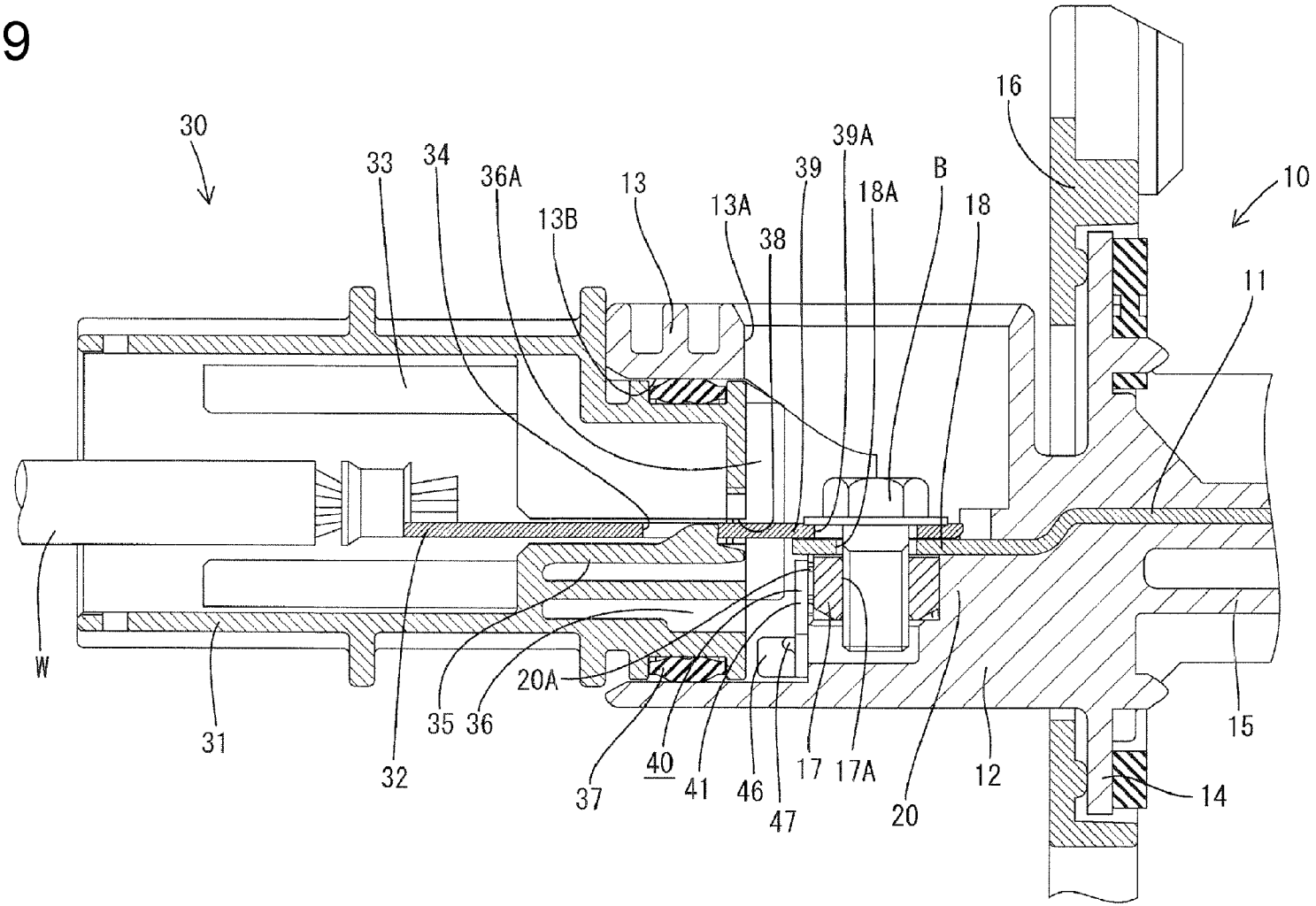
FIG. 9 is a side view in section showing a properly connected state of the connector.
Figure 10:
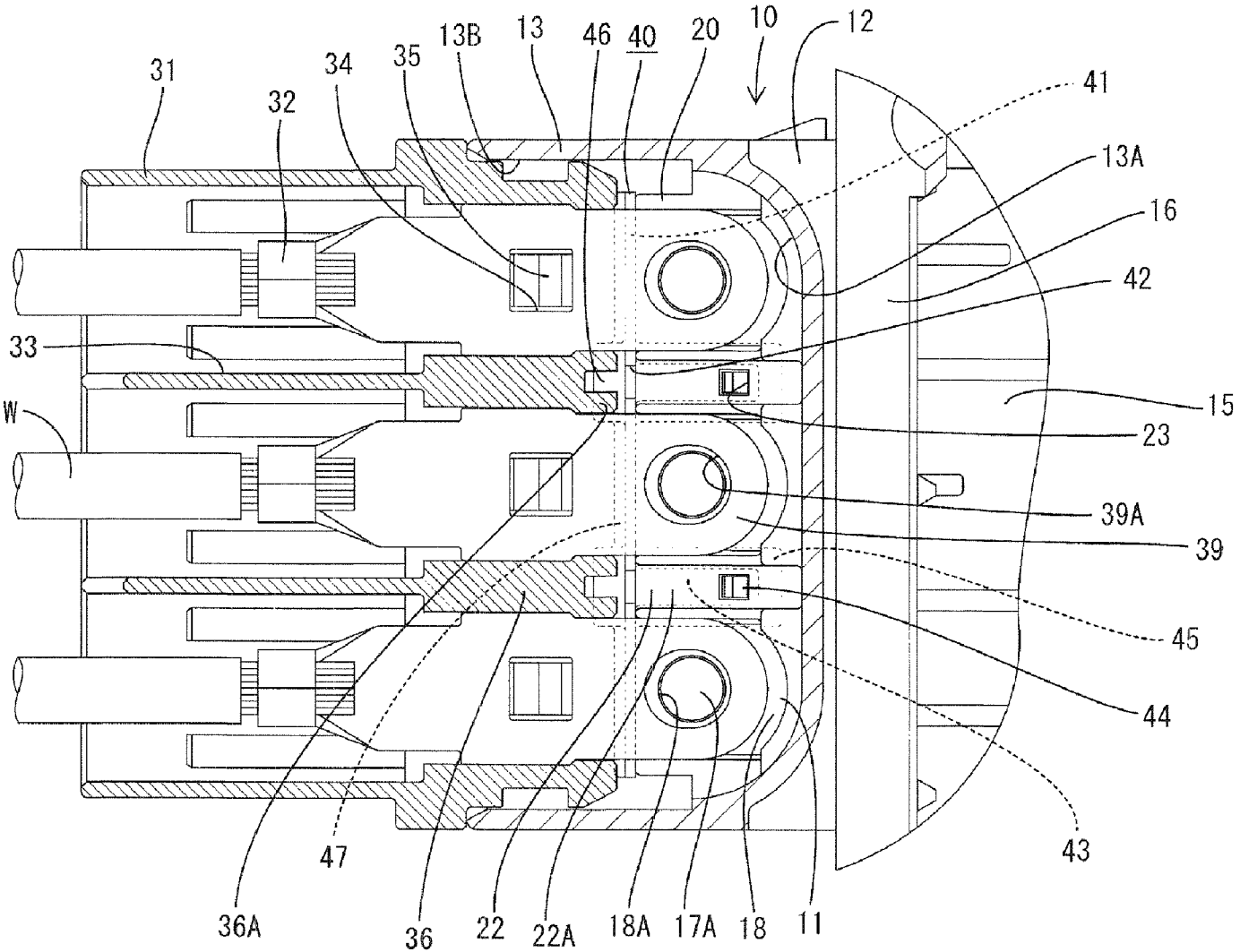
FIG. 10 is a plan view partly in section showing the state of FIG. 9.

The second connector 30 then is pushed in the connecting direction CD toward the first connector 10 with the second fitting 36 of the second connector 30 faced toward the first fitting 13 of the first connector 10, as shown in FIG. 1. As a result, the second connecting portions 39 of the second terminals 32 project into the first fitting 13 to reach positions adjacent and above the first connecting portions 18 at the back of the first fitting 13. More particularly, the second fitting 36 is fit into the first fitting 13 and the second connecting portions 39 move along the upper surfaces of the first connecting portions 18. If the second connector 30 is in the proper orientation, the front projections 36A of the second connector 30 are inserted adjacent to and above the projections 46 without contacting the projections 46 of the nut cover 40 so that the two connectors 10, 30 reach a properly connected state, as shown in FIG. 9. At this time, the second connecting portions 39 reach positions right above and adjacent to the first connecting portions 18. Accordingly, the second bolt holes 39A, the first bolt holes 18A and the shaft holes 17A of the nuts 17 align coaxially one over another (see FIG. 10). Bolts B are inserted into the first and second bolt holes 18A, 39A via the upper opening 13A of the first fitting 13 and fixed and tightened using the nuts 17. In this way, the first and second terminals 11, 32 are pressed strongly into contact to be connected electrically.

Figure 11:
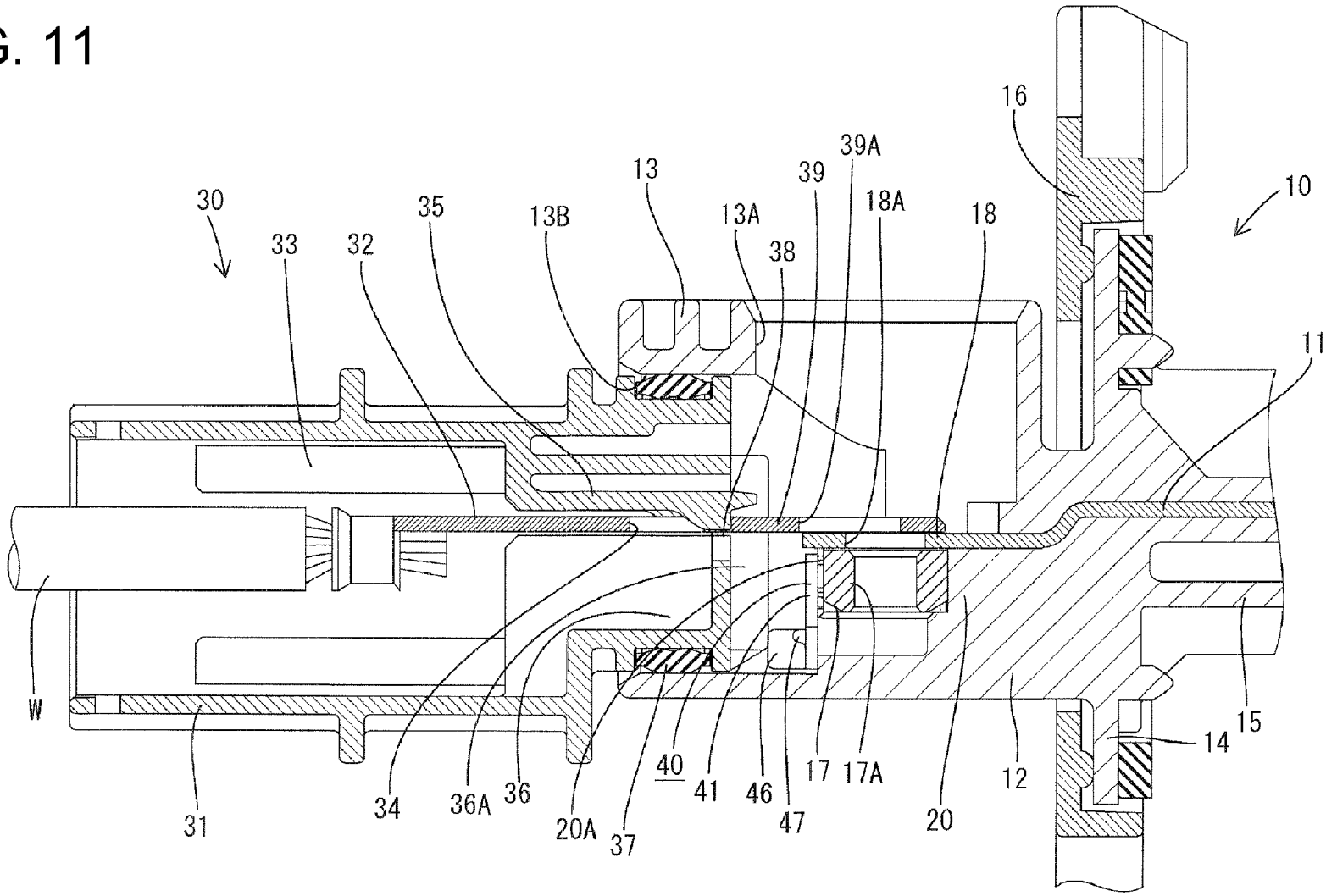
FIG. 11 is a side view in section showing a state where a vertically inverted second connector is in contact with projecting portions.

On the other hand, the second connector 30 may be vertically inverted or otherwise oriented improperly. In this situation, the second connector 30 is pushed toward the first connector 10 with the second fitting 36 of the second connector 30 faced toward the first fitting 13 of the first connector 10. Thus, the second connecting portions 39 of the second terminals 32 project into the first fitting portion 13 and reach the positions above the first connecting portions 18 of the first terminals 11 and the second fitting 36 is fit partly into the first fitting 13 as in the case where the second connector 30 is oriented properly. However, the front projections 36A of the improperly oriented second connector 30 contact the projections 46 of the nut cover 40 to prevent further connection (see FIG. 11) before the second fitting 36 reaches the proper position in the first fitting 13. Thus, the two connectors 10, 30 are prevented from being connected if the second connector 30 is inverted vertically.

Figure 12:
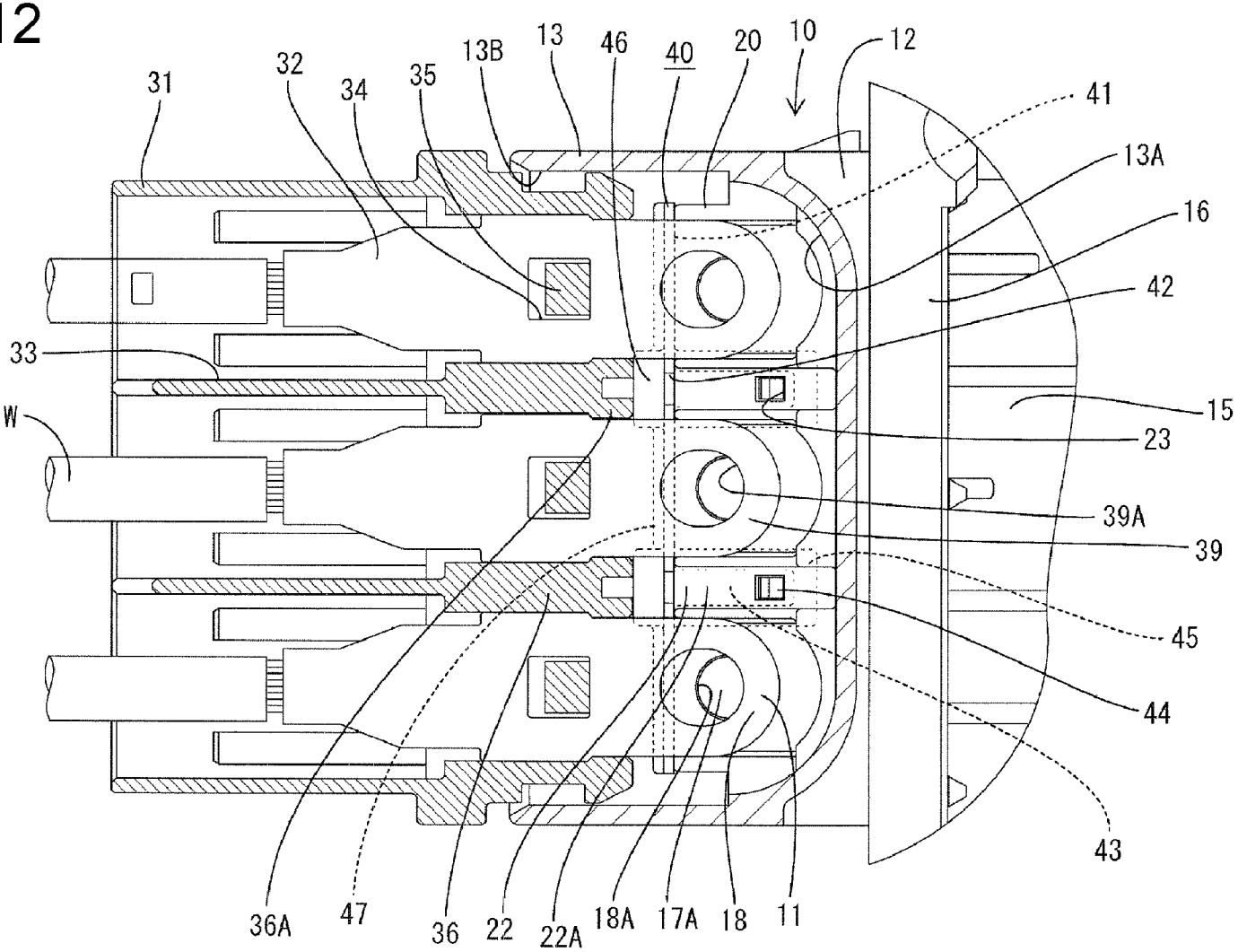
FIG. 12 is a plan view partly in section showing the state of FIG. 11.

The first and second bolt holes 18A and 39A are offset in forward and backward directions when the front projections 36A contact the projections 46 of the nut cover 40, making it impossible to insert the bolts B (see FIG. 12). In this way, the terminals of the connectors 10, 30 cannot be bolted when the second connector 30 is inverted vertically inverted.

As described above, the detachably attachable nut cover 40 prevents nuts 17 from coming out of the nut accommodating portion 20. Further, the projections 46 of the nut cover 40 permit connection of the second connector 30 if the second connector 30 is in the proper orientation, but contact the second connector 30 to prevent connection if the second connector 30 is oriented improperly.

The present invention is not limited to the above described and illustrated embodiment. For example, the following embodiments are also included in the technical scope of the present invention.

Although the invention is applied to a device connector in the above embodiment, it is also applicable to connectors other than device connectors.

The engaging portions are the engaging pieces 43 resiliently deformable up and down in the above embodiment. However, the invention is not limited to this and the engaging portions may be of any form provided that they are engageable with the nut accommodating portion. For example, the engaging portions may be a pair of engaging legs or the like that are resiliently displaceable in width directions so as to hold the nut accommodating portion from the opposite ends.

The cover main body 41 of the nut cover 40 is a plate covering the entrance 20A of the nut accommodating portion 20 in the above embodiment. However, the cover main body may be of any form provided that it can prevent the nuts from coming out. For example, the cover main body may be in the form of a bar crossing the entrance.

What is claimed is:

1. A connector, comprising:

at least one terminal to be connected with at least one terminal of a mating connector by bolting;

at least one nut accommodating portion for accommodating at least one nut for bolting, an entrance formed at a surface of the nut accommodating portion that is connectable with the mating connector, the entrance enabling the insertion and withdrawal of the nut; and at least one nut cover attachable to the nut accommodating portion for preventing the nut from coming out through the entrance, the nut cover including at least one improper insertion preventing portion for permitting a connection with the mating connector when the mating connector is in a proper orientation while contacting the mating connector to prevent the connection when the mating connector is not in the proper orientation.

2. The connector of claim 1, wherein at least one partition wall is provided to partition the nut accommodating portion into a plurality of sections.

3. The connector of claim 2, wherein the improper insertion preventing portion is provided at the partition wall.

4. The connector of claim 2, wherein the nut accommodating portion is formed with at least one mounting portion, and the nut cover having at least one engaging piece and at least one plate piece insertable into the mounting portion.

5. The connector of claim 4, wherein a part of the mounting portion that receives the engaging piece is formed in the partition walls and a part of the mounting portion that receives the plate piece is formed in a part of the nut accommodating portion below a part where the nut is arranged.

6. The connector of claim 4, wherein engaging recesses are formed in an upper surface of the part of the mounting portion that receives the engaging piece, and the nut cover has at least one engaging projection that is insertable into the engaging recess.

7. The connector of claim 6, wherein rear surfaces of the respective engaging projections are inclined gradually out toward the front, and front surfaces thereof are substantially perpendicular to the engaging pieces.

8. The connector of claim 6, wherein the nut cover has at least one cutout and the engaging projections are arranged to be seen through more cutouts when the engaging pieces are in a natural state.

9. The connector of claim 6, wherein the plate piece extends from a cover main body of the nut cover substantially along a connecting direction, the plate piece being spaced below the engaging piece for permitting resilient deformation of the engaging piece.

10. The connector of claim 9, wherein the plate piece is thicker than the engaging piece.

11. The connector of claim 9, wherein the height of the improper insertion preventing portion exceeds the thickness of the plate piece, and is more than half a vertical dimension of the cover main body at the positions of the cutouts.

12. The connector of claim 1, wherein the nut is accommodated with substantially no clearance defined to the nut accommodating portion.

13. A connector assembly comprising the connector of claim 1 and a mating connector connectable therewith, wherein the connector comprises at least one terminal to be connected with at least one terminal of the mating connector by bolting.

* * * * *